US006412926B1

(12) United States Patent
Okuda

(10) Patent No.: US 6,412,926 B1
(45) Date of Patent: Jul. 2, 2002

(54) INK-JET PRINTER HEAD AND INK-JET PRINTER

(75) Inventor: Masakazu Okuda, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/807,536

(22) PCT Filed: Oct. 13, 1999

(86) PCT No.: PCT/JP99/05639

§ 371 (c)(1),
(2), (4) Date: Jul. 23, 2001

(87) PCT Pub. No.: WO00/21754

PCT Pub. Date: Apr. 20, 2000

(30) Foreign Application Priority Data

Oct. 14, 1998 (JP) ..... 10/292525

(51) Int. Cl.[7] ..... B41J 2/045
(52) U.S. Cl. ..... 347/70
(58) Field of Search ..... 347/68, 70

(56) References Cited

U.S. PATENT DOCUMENTS 4,443,807 A * 4/1984 Koto ..... 347/70
5,189,437 A * 2/1993 Michaelis et al. ..... 347/47

FOREIGN PATENT DOCUMENTS

| | | |
|---|---|---|
| JP | 53-12138 | 4/1978 |
| JP | 61-141566 | 6/1986 |
| JP | 5-84909 | 4/1993 |
| JP | 6-171080 | 6/1994 |
| JP | 10-24570 | 1/1998 |

* cited by examiner

*Primary Examiner*—John Barlow
*Assistant Examiner*—Michael S Brooke
(74) *Attorney, Agent, or Firm*—McGnn & Gibb, PLLC

(57) ABSTRACT

An ink-jet recording head is capable of always performing high-speed recording with high image quality in a stable manner independently of a change in the environmental temperature while an apparatus is in operation. The configurations of a nozzle 7, an ink supply aperture 6, and a pressure generating chamber 2 are set so that an inertance $m_T$ and an acoustic resistance $r_T$ (the values substantially at a temperature of 20° C.) of the nozzle 7, the ink supply aperture 6, and the pressure generating chamber 2 in an ink-filled state satisfy expressions (1) and (2), respectively:

$$0<m_T<1.9\times10^8[\mathrm{kg/m^4}] \quad (1)$$

$$4.0\times10^{12}<r_T<11.0\times10^{12}[\mathrm{Ns/m^5}] \quad (2)$$

20 Claims, 9 Drawing Sheets

$C_3$ :INERTANCE (ACOUSTIC MASS)

$\gamma_T$ :ACOUSTIC RESISTANCE $m_T$ :ACOUSTIC CAPACITANCE

TIME-DEPENDENT CHANGE IN MENISCUS POSITION AFTER DISCHARGE

INK-JET PRINTER HEAD AND INK-JET PRINTER

TECHNICAL FIELD

The present invention relates to an ink-jet recording head adapted to discharge minute ink droplets from a nozzle to record characters or images, and an ink-jet recording apparatus in which the ink-jet recording head is installed.

BACKGROUND ART

Hitherto, as one of this type of recording heads, an "on-demand type ink-jet recording head" that discharges ink droplets from a nozzle according to printing information has been extensively known, An on-demand type ink-jet recording head has been disclosed in, for example, Japanese Examined Patent Publication (JP-B) No. 53-12138. FIG. 11 is a sectional view that conceptually shows a basic construction of an ink-jet recording head known as a Caesar type among the on-demand type ink-jet recording heads.

As shown in FIG. 11, in the Caesar type recording head, a pressure generating chamber 91 and a common ink chamber 92 are coupled via an ink supply aperture (ink supply passage) 93 at an ink upstream side. At an ink downstream side, the pressure generating chamber 91 and a nozzle 94 are coupled. A bottom plate of the pressure generating chamber 91 shown in the drawing is composed of a diaphragm 95, and a piezoelectric actuator 96 is provided on the rear surface of the diaphragm 95.

In such a construction, to perform a printing operation, the piezoelectric actuator 96 is driven to displace the diaphragm 95 on the basis of printing information, thereby suddenly changing the volume of the pressure generating chamber 91 to produce a pressure wave in the pressure generating chamber 91. The pressure wave causes a part of the ink charged in the pressure generating chamber 91 to be injected outside through the nozzle 94 in the form of an ink droplet 97. The discharged ink droplet 98 impacts onto a recording medium, such as recording paper, and forms a recording dot. Such a recording dot is repeatedly formed on the basis of the printing information thereby to record a character or an image on the recording medium.

Referring now to FIGS. 12(*a*) through (*d*) and FIG. 13, the relativity between the behaviors of a meniscus and printing performance will be discussed.

FIGS. 12(*a*) through (*d*) are sectional views illustrating a changing process of a meniscus M of the nozzle 94 in the aforesaid ink droplet discharging process, and FIG. 13 is a graph showing time-dependent changes of the position of the meniscus M after the ink droplet is discharged. Before the ink droplet 97 is discharged, the meniscus M is set so that it is positioned substantially flush with an aperture surface of the nozzle 94, as shown in FIG. 12(*a*). When the piezoelectric actuator 96 is driven and the ink droplet 97 is discharged, the meniscus M moves back into the nozzle 94 according to the amount of the discharged ink, as shown in FIG. 12(*b*). At this time, if the next discharge is implemented while the meniscus M is still back in the nozzle 94, as shown in FIG. 12(*c*), then a discharging condition (a droplet diameter, droplet speed, etc.) changes, or a discharge failure results. Hence, in order to achieve stable continuous discharge, it is important to wait until the meniscus M that has retreated is moved back to the vicinity of its initial position by the action of surface tension, as illustrated in FIG. 12(*d*), before the next discharge cycle is implemented. More specifically, it is crucial to start the next discharge cycle after a time required for refilling after the ink is discharge has elapsed (refilling time $t_r$), as shown in FIG. 13.

From the descriptions above, it can be understood that a maximum discharging frequency fe of the ink-jet recording head depends on the refilling time $t_r$ of the head. More specifically, to attain high-speed recording by operating at the maximum discharging frequency fe, it is necessary to shorten the refilling time $t_r$ so as to satisfy a condition indicated by $t_r<1/fe$. To be more specific, the refilling time $t_r$ can be reduced by increasing a cross-sectional area of the passage system formed of the nozzle 94, the pressure generating chamber 93, and the ink supply aperture (ink supply passage) 91, or by decreasing the viscosity of the ink thereby to decrease a passage resistance.

However, reducing the passage resistance results in a side effect of an increase in an overshoot $X_{max}$ of the meniscus M, as shown in FIG. 13, although the refilling time $t_r$ is shortened. More specifically, if the overshoot $X_{max}$ is large, then the condition (position or speed) of the meniscus M immediately before the discharge of the ink droplet 97 does not remain constant, leading to an inconvenient problem in that the droplet diameter or the droplet speed (discharging speed) of the droplet 97 varies. Therefore, to secure the accuracy in the droplet diameter or the droplet speed, it is required to control the overshoot $X_{max}$ of the meniscus M to a predetermined value or less. Especially to accomplish recording with high image quality by droplet diameter modulation, high accuracy is required of the droplet diameter and the droplet speed. For this reason, the overshoot amount $X_{max}$ must be approximately 10 $\mu$m at maximum. A specific measure for suppressing the overshoot $X_{max}$, the cross-sectional area of the passage system may be reduced or the ink viscosity may be increased so as to increase the passage resistance. As mentioned above, however, increasing the passage resistance causes the refilling time $t_r$ to be prolonged, so that high-speed recording is inconveniently sacrificed.

Thus, in the ink-jet recording head, it is extremely difficult to realize the recording with high image quality performed by droplet diameter modulation, and also high-speed recording at the same time, because the conflicting conditions, namely, the shortened refilling time $t_r$ and the restrained overshoot $X_{max}$ must be satisfied. In the past, however, attempts have been made to realize both the recording with high image quality and high-speed recording by maximizing the reduction in the refilling time and the restraint of the overshoot by devising the shapes of the nozzle or ink supply aperture (the ink supply passage) or the like, and by adjusting the viscosity of the ink.

According to the conventional attempts mentioned above, however, it has been extremely difficult to always achieve the shortened refilling time and the restrained overshoot over a wide operating temperature range of the apparatus. This is because the physical properties of the ink change due to environmental temperatures, and as a result, refilling characteristics markedly change.

As it will be discussed hereinafter, the refilling characteristics of the ink-jet recording head are governed by the inertance (acoustic mass) and the acoustic resistance of the passage system formed of a nozzle, an ink supply aperture (an ink supply passage), a pressure generating chamber, etc., and the acoustic capacitance of a meniscus. Among these factors, the inertance depends on the density of ink, the acoustic resistance depends on the viscosity of ink, and the acoustic capacitance depends on the surface tension of ink. Therefore, if the ink properties (density, viscosity, and surface tension) change according to environmental temperatures, then the characteristic parameters (inertance, acoustic resistance, and acoustic capacitance) of a passage system change accordingly, resulting in a significant change in the refilling characteristics. Actually, when the operating temperature range of the apparatus is 10 to 35° C. (in the vicinity of room temperature), the dependence-on-temperature of the density and the surface tension can be almost ignored, but the temperature-dependent change of the ink viscosity cannot be ignored.

For instance, if the operating temperature of the apparatus is set to 10 to 35° C., then the ink viscosity of a typical water-based ink develops an approximately 2.0-fold to 2.5-fold change. If the environmental temperature is low, then the ink viscosity increases with a resultant increase in the acoustic resistance of the passage system, making it difficult to obtain a desired refilling time $t_r$. Conversely, if the environmental temperature rises, then the ink viscosity decreases, so that the overshoot $X_{max}$ of the meniscus increases although the refilling time $t_r$ shortens.

As a specific example, an example of a result of an experiment on an ink-jet recording head will be described. At room temperature (20° C.), the refilling time $t_r$ was 90 μs, and the overshoot $X_{max}$ r, was 5 μm. In the ink-jet recording head, a target drive frequency is 10 kHz, and the allowable value of the overshoot $X_{max}$ is 10 μm at this time. Hence, at the room temperature (20° C.), the target value (100 μs or less) of the refilling time $t_r$ can be secured, and the overshoot $X_{max}$ can be restrained. However, when the environmental temperature was lowered to 10° C., then the overshoot $X_{max}$ was decreased to 2 μm and therefore satisfied the overshoot condition, whereas the refilling time increased to $t_r$ 116 μs, so that it was no longer possible to secure the target refilling time $t_r$. Conversely, when the environmental temperature was increased to 35° C., the refilling time $t_r$ was shortened to 72 μs and therefore satisfied the refilling time condition, whereas the overshoot increased to 14 μm, indicating that it was no longer possible to restrain the overshoot $X_{max}$.

As described in detail above, since the ink viscosity greatly depends on temperature, it is extremely difficult to secure a target refilling time and to restrain the overshoot at the same time over a wide apparatus operating temperature range. Especially when the diameter of ink droplets to be discharged is set to a larger value so as to realize high-speed recording, marked deterioration is observed in the printing performance attributable to the temperature-dependent changes in the physical properties of ink. For example, when the recording resolution is set to a low value, approximately 400 dpi, the required ink droplet diameter (maximum droplet diameter) will be about 38 μm to about 43 μm. When such a large ink droplet is discharged, the amount of recession of a meniscus immediately after the discharge is large. This is likely to cause an increase in the refilling time or the overshoot, and also leads to increased susceptibility to the influences of the changes in environmental temperature. In fact, no ink-jet recording head has conventionally been available that is capable of perfectly securing the refilling time and restraining the overshoot at the same time under a condition where an ink droplet diameter of a maximum droplet diameter Hz or more, an overshoot allowable value of 10 μm, and the apparatus operating temperature ranges from 10 to 35° C. In the present specification, the droplet diameter means the diameter obtained by converting the total amount of ink discharged in one discharge cycle into a single spherical ink droplet.

Accordingly, an object of the present invention is to provide an ink-jet recording head capable of always securing a target refilling time and restraining overshoot at the same time even if an environmental temperature changes while an apparatus is in operation, and also capable of discharging at high speed a stable ink droplet with highly accurate droplet diameter and droplet speed. It is another object of the invention to provide an ink-jet recording apparatus in which the aforesaid head is installed.

DISCLOSURE OF THE INVENTION

To this end, the invention described in claim 1 relates to an ink-jet recording head that includes a pressure generating chamber filled with ink, pressure generating means for generating a pressure in the pressure generating chamber, an ink supply chamber for supplying the ink to the pressure generating chamber, an ink supply passage for establishing communication between the ink supply chamber and the pressure generating chamber, and a nozzle in communication with the pressure generating chamber, the pressure generating means causing a pressure change to take place in the pressure generating chamber so as to discharge an ink droplet from the nozzle, wherein the configurations of the nozzle, the ink supply passage, and the pressure generating chamber are set so that a total sum $m_T$ of the inertance and a total sum $r_T$ of acoustic resistance (the values at a temperature of about 20° C.) of the nozzle, the ink supply passage, and the pressure generating chamber in an ink-filled state satisfy expressions (4) and (5):

$$0<m_T<1.9\times10^8[\mathrm{kg/m^4}] \quad (4)$$

$$4.0\times10^{12}<r_T<11.0\times10^{12}[\mathrm{Ns/m^5}] \quad (2)$$

The invention described in claim 2 relates to the ink-jet recording head described in claim 1, wherein the nozzle has a tapered portion whose diameter gradually increases toward the pressure generating chamber, and the tapering angle of the tapered portion is 10 to 45 degrees.

The invention described in claim 3 relates to the ink-jet recording head described in claim 1, wherein the nozzle is composed of a straight portion provided in the vicinity of an opening and a tapered portion that gradually increases toward the pressure generating chamber, and the tapering angle of the tapered portion is 15 to 45 degrees.

The invention described in claim 4 relates to the ink-jet recording head described in claim 1, wherein the diameter of the nozzle gradually increases toward the pressure generating chamber, the longitudinal section of the nozzle is shaped into a curve that has a radius substantially equal to the length of the nozzle, and the length of the nozzle is 50 to 100 μm.

The invention described in claim 5 relates to the ink-jet recording head described in claim 1, 2, 3, or 4, wherein the opening diameter of the nozzle is 25 to 32 μm.

The invention described in claim 6 relates to the ink-jet recording head described in claim 1, wherein the ink supply passage is an ink supply aperture for establishing communication between the ink supply chamber and the pressure generating chamber.

The invention described in claim 7 relates to the ink-jet recording head described in claim 1, wherein the maximum droplet diameter of the ink droplet is set to 38 to 43 μm.

The invention described in claim 8 relates to the ink-jet recording head described in claim 1, wherein the ink-jet recording head employs an ink with its surface tension set to 25 to 35 mN/m.

The invention described in claim 9 relates to the ink-jet recording head described in claim 1, wherein the ink-jet recording head employs an ink having its viscosity set such that the total sum $r_T$ of the acoustic resistance (the value at a temperature of substantially 20° C.) of the nozzle, the ink supply passage, and the pressure generating chamber in an ink-filled state satisfies expression (6):

$$4.0\times10^{12}<r_T<11.0\times10^{12}[\mathrm{Ns/m^5}] \quad (6)$$

The invention described in claim 10 relates to an ink-jet recording apparatus incorporating the ink-jet recording head described in any one of claims 1 to 9.

BRIEF DESCRIPTION OF THE DRAWINGS

FIG. 1(*b*) is an exploded sectional view showing the ink-jet recording head in a disassembled state;

BEST MODE EMBODYING THE INVENTION

Figure 1:
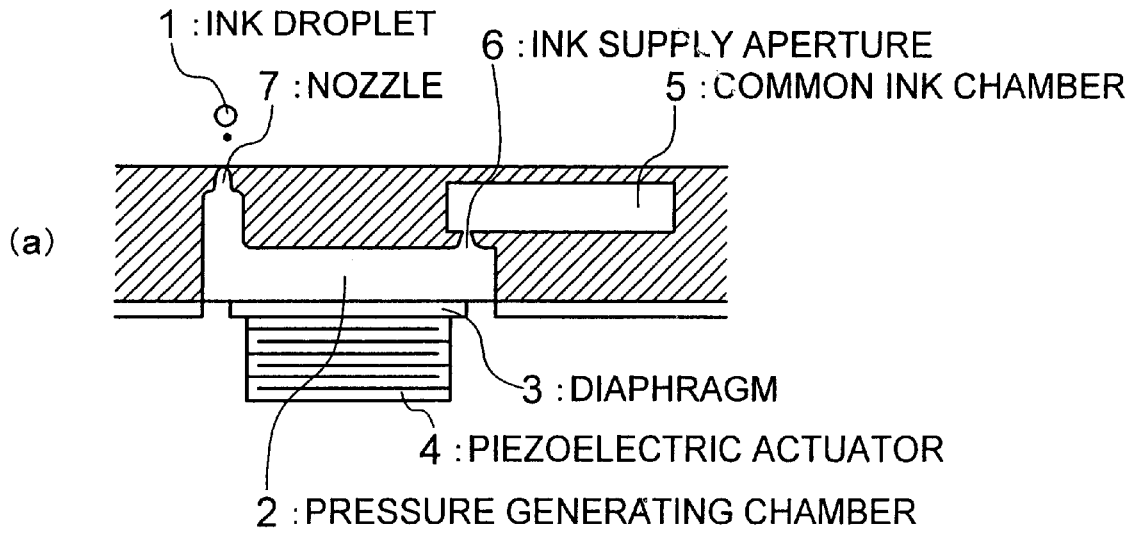
FIG. 1(*a*) is a sectional view conceptually showing the construction of an ink-jet recording head used in a first embodiment of the present invention.
Figure 1:
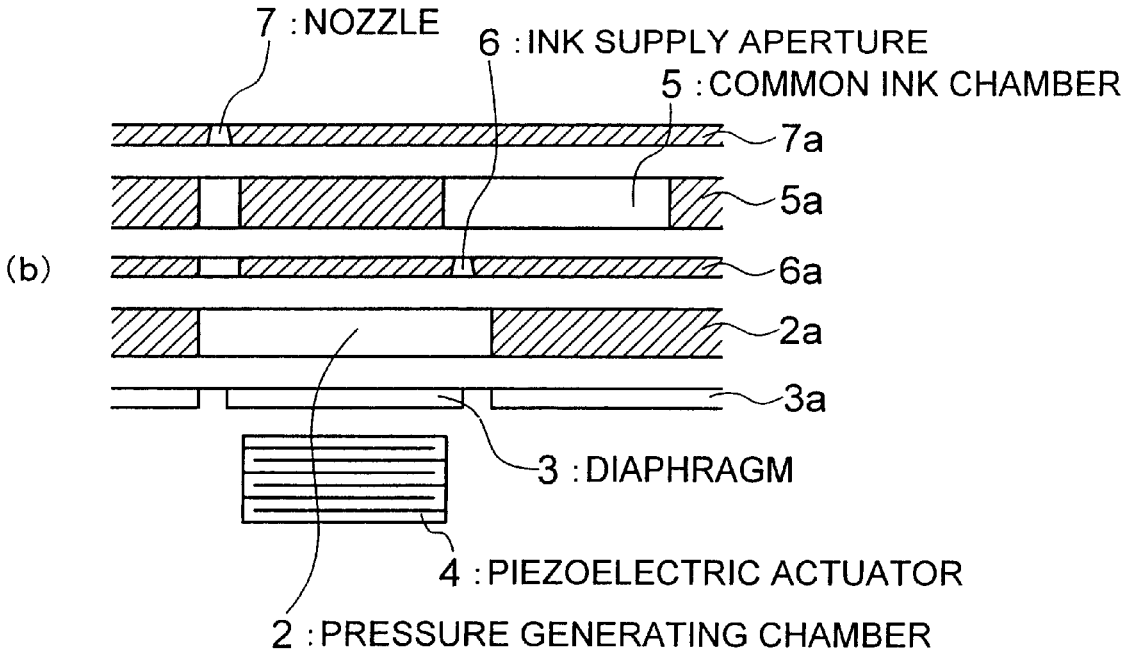

Referring now to the drawings, the embodiments of the present invention will be described.

To help better understand the present invention, the theoretical foundation of the validity of the present invention will be first explained by using a concentrated constant system equivalent circuit model.

Figure 9:
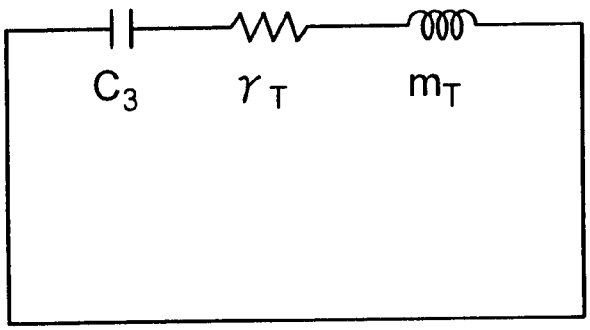
FIG. 9 is a diagram for explaining the theoretical validity of the present invention, and is an equivalent circuit diagram of an ink-jet recording head in a refilling operation.

FIG. 9 is an equivalent circuit diagram showing an ink-jet recording head in a refilling operation. From the equivalent circuit, it is understood that the meniscus movement in the refilling operation is governed by the differential equation of expression (7):

$$m_T=\frac{d^2x}{dt^2}+r_T\frac{dx}{dt}+\frac{1}{c_3}x=0 \quad (7)$$

In expression (7), $m_T$ denotes a total sum of the inertance (acoustic mass) of a nozzle, an ink supply passage, and a pressure generating chamber in an ink-filled state. An inertance m in each component is determined by expression (8) when a conduit sectional area is denoted as S [m2], a conduit length is denoted as I [m], and an ink density is denoted as p [kg/m$^3$]:

$$m=\int_o^l\frac{\rho}{s}dx \quad (8)$$

In expression (7), $r_T$ denotes the total sum of the acoustic resistances of the nozzle, the ink supply passage, and the pressure generating chamber in the ink-filled state. An acoustic resistance r in each component at a portion, where the conduit section is round, is determined by expression (9) when the ink viscosity is denoted as η [Pa·s] and the conduit diameter is denoted as d [m]. At a portion where the conduit section is rectangular, the acoustic resistance r is determined by expression (10) when the aspect ratio (the slenderness ratio) of the section is denoted as z:

$$r=\int_o^l\frac{128\eta}{\pi d^4}dx \quad (9)$$

$$r=\int_o^l\frac{12\eta l}{s^2}dx\left\{0.33\times1.02\left(z+\frac{1}{z}\right)\right\} \quad (10)$$

In expression (7), C3 denotes the acoustic capacitance [m$^5$/N] of a meniscus, and is determined by expression (11) when a nozzle opening diameter is denoted as $d_3$ [m], the surface tension of ink is denoted as σ [N/m], and the recession of the meniscus is denoted as x [m]:

$$c_3=\frac{\pi d_3^4}{64\rho}\sqrt{1+\frac{16x^2}{d_3^2}} \quad (11)$$

Figure 12:
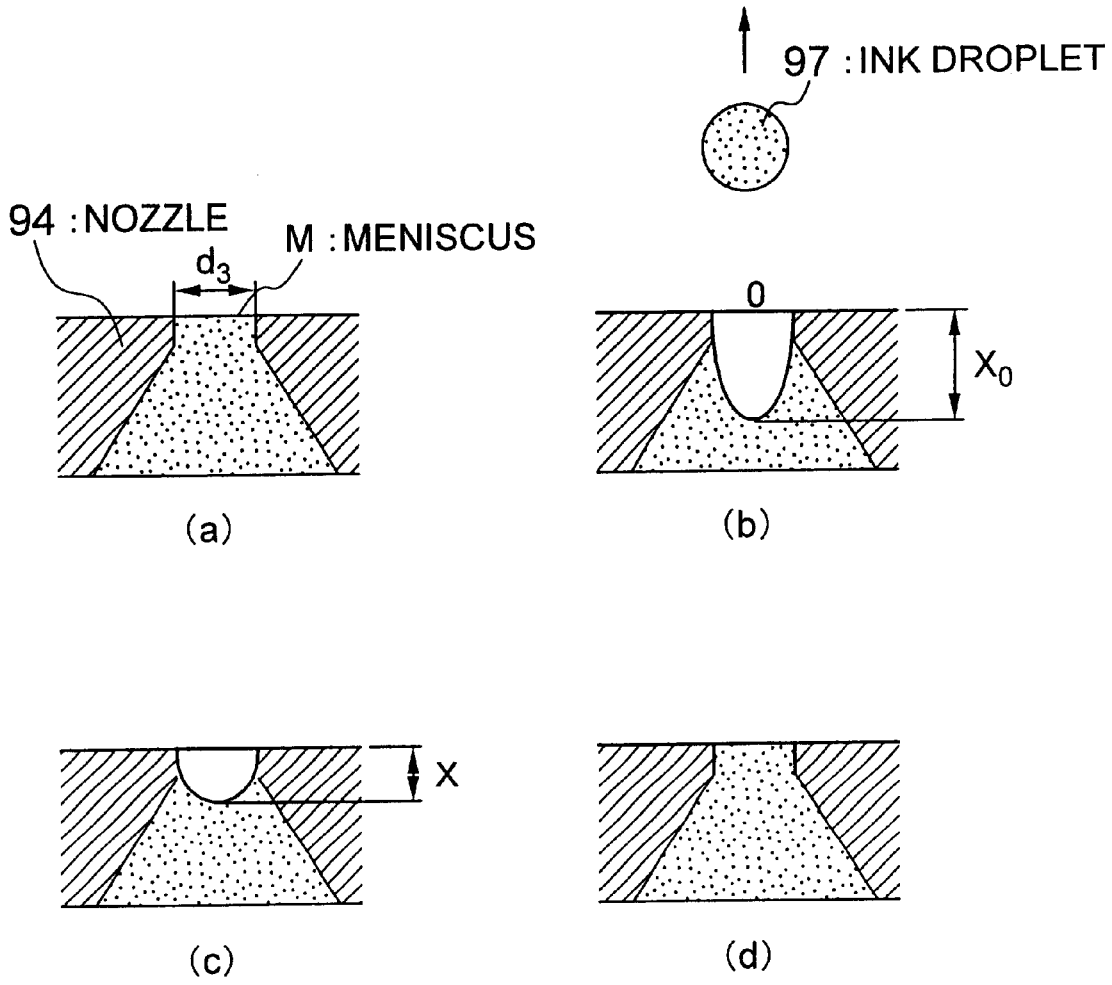
FIGS. 12(*a*) through (*d*) are diagrams for explaining the conventional technology, and are sectional views showing how the meniscus of a nozzle changes in the aforesaid ink droplet discharging process.
Figure 13:
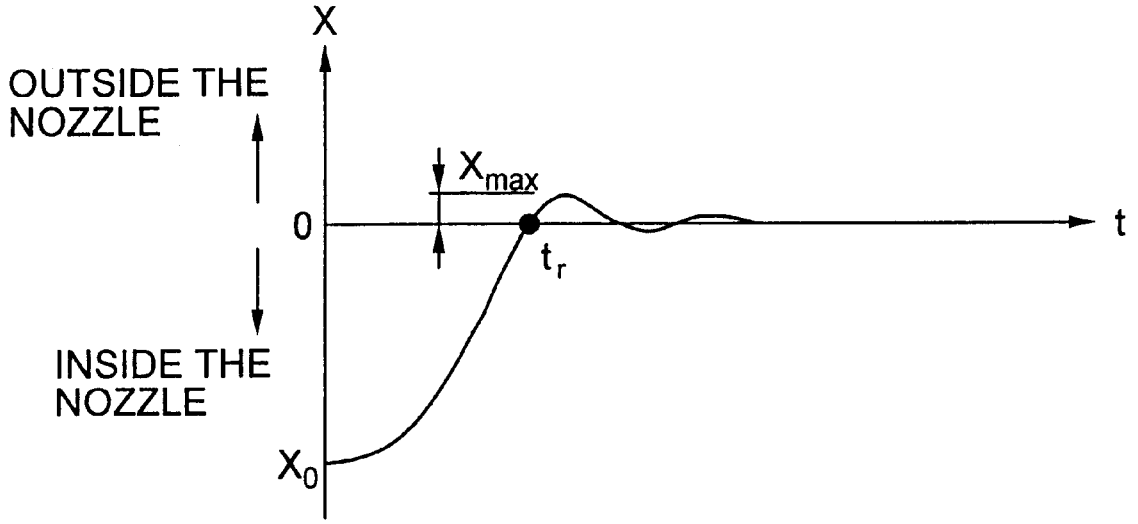
FIG. 13 is a diagram for explaining a prior art, and shows the time-dependent changes of the position of the meniscus after an ink droplet is discharged.

To determine the time-dependent changes of the position of the meniscus from expression (7), it is required to give an initial position $x_0$ of the meniscus at the start of refilling (refer to FIG. 12(*b*) and FIG. 13). When the droplet diameter is denoted as $d_d$ [m], the initial position $x_0$ of the meniscus is given by expression (12). A coefficient κ normally takes a value of about 0.5 to about 0.7 although it somewhat changes, depending upon the shape of the nozzle, or the like. In calculation performed primarily by the inventor related to the present application, the coefficient was set to κ=0.67 based on the result of experiments.

$$x_0=\kappa\frac{d_d^3}{d_3^2} \quad (12)$$

As can be understood from expression (7) through expression (12), once the nozzle opening diameter $d_3$ (FIG. 12(*a*)), the surface tension σ of the ink, and the droplet diameter $d_d$ of the ink are determined, there are only two parameters that govern the refilling operation, namely, the inertance $m_T$ and the acoustic resistance $r_T$. In other words, the combination of the inertance $m_T$ and the acoustic resistance $r_T$ decides the refilling characteristics (refilling time and overshoot amount). In this case, setting the inertance $m_T$ at a certain value will determine the upper limit of the acoustic resistance $r_T$ for attaining a target refilling time and the lower limit of the acoustic resistance $r_T$ for controlling the overshoot amount to an allowable value or less. An actual example is illustrated in the graph shown in FIG. 10 (calculated under a condition where $d_3$=30 μm, σ=33 mN/m, $d_d$=40 μm, and the discharge frequency fe=10 kHz). The graph shown in FIG. 10 plots the upper/lower limits of the acoustic resistance $r_T$ corresponding to each inertance $m_T$ when the inertance $m_T$ is changed within the range of 0.5 to $4.5\times10^8$ kg/m$^4$.

Figure 10:
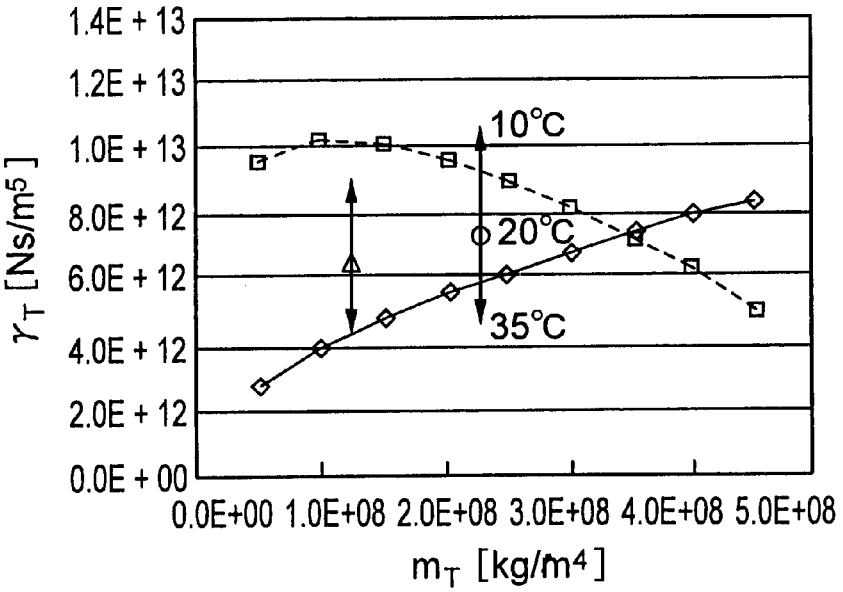
FIG. 10 is a diagram for explaining the theoretical validity of the present invention, and is a graph showing the relationship between an inertance $m_T$ and an acoustic resistance $r_T$ of an entire passage diameter.
Figure 11:
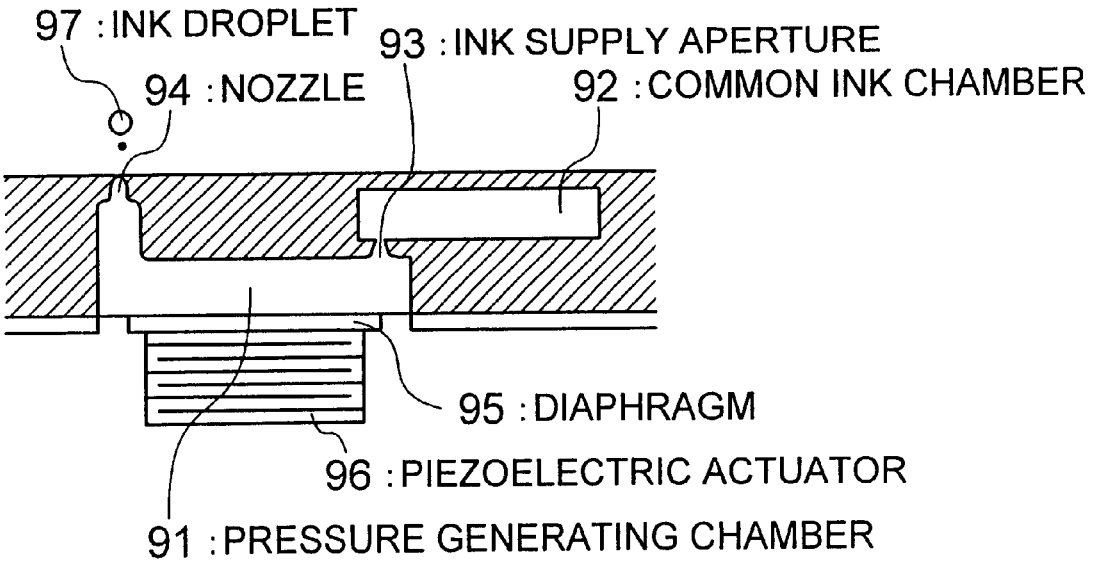
FIG. 11 is a diagram for explaining a conventional technology, and is a sectional view conceptually showing the basic construction of an ink-jet recording head known as a Caesar type among on-demand type ink-jet recording heads.

In FIG. 10, plotting indicated by □ shows the upper limit of the acoustic resistance $r_T$ for securing a target refilling time (100 μs). If the acoustic resistance $r_T$ exceeds the upper limit, then a target discharge frequency cannot be obtained. Plotting indicated by ♦ shows the lower limit of the acoustic resistance $r_T$ for controlling the overshoot amount to the allowable value (10 μm) or less. Hence, it will be possible to secure the target refilling time and to restrain the overshoot at the same time by setting the inertance $m_T$ and the acoustic resistance $r_T$ such that the acoustic resistance $r_T$ stays within the range defined by the upper limit and the lower limit (the hatched area).

For instance, in an ink-jet recording head, it is assumed that the combination of the inertance $m_T$ and the acoustic resistance $r_T$ (calculated using an ink viscosity of 2.9 mPa·s at 20° C.) lies at the position indicated by plotting denoted by O shown in FIG. 10 when the environmental temperature is room temperature (20° C.). At the environmental temperature of the room temperature (20° C.), the acoustic resistance $r_T$ lies between the upper limit and the lower limit, so that the target refilling time can be secured and the overshoot can be restrained at the same time. However, if the environmental temperature changes in the range of 10 to 35° C., then the ink viscosity η changes in the range of 1.8 to 3.8 mPa·s. This causes the acoustic resistance $r_T$ to change in the range defined by the arrows in FIG. 10. This means that, at a lower temperature, the acoustic resistance $r_T$ exceeds the upper limit, so that refilling time will exceed the target. At a higher temperature, the acoustic resistance $r_T$ exceeds the lower limit, so that the overshoot amount will exceed the allowable value. In other words, the ink-jet recording head has a head structure that cannot successfully cope with the changes in environmental temperature.

Another ink-jet recording head will be discussed. In this head, the combination of the inertance $m_T$ and the acoustic resistance $r_T$ lies at the position indicated by plotting denoted by Δ shown in FIG. 10 when the environmental temperature is the room temperature (20° C.). As is obvious from FIG. 10, this ink-jet recording head always stays between the upper limit and the lower limit even if the environmental temperature changes in the range of 10 to 35° C. Therefore, this head is able to always secure a target refilling time and restrain overshoot at the same time within the range of 10 to 35° C., and is accordingly able to successfully cope with changes in environmental temperature. In other words, to enable an ink-jet recording head to successfully deal with changes in environmental temperature, it is crucial to set the inertance $m_T$ and the acoustic resistance $r_T$ such that the acoustic resistance $r_T$ is always positioned between the upper limit and the lower limit within an apparatus operating temperature range.

Conventionally, however, a design concept based on the viewpoint of optimized balance between the inertance $m_T$ and the acoustic resistance $r_T$ has not been known, For this reason, according to the analytical results obtained primarily by the inventor of the present application, no head is available that is designed to have an ink droplet diameter set to 38 to 43 μm, and the acoustic resistance $r_T$ always lies within a permissible range (the area between an upper limit value and a lower limit value) over the full range of environmental temperatures from 10 to 35° C.

As can be understood from expression (7) to expression (12), the allowable range of the inertance $m_T$ and the acoustic resistance $r_T$ is inherently represented as a function that depends on five parameters, namely, the ink droplet diameter $d_d$, the nozzle opening diameter $d_3$, the surface tension a of ink, a maximum discharge frequency, and an allowable overshoot value. However, the present invention covers a large droplet in a low-resolution recording operation (approximately 400 dpi) wherein the influences of an environmental temperature is particularly marked. Therefore, the allowable range of the inertance $m_T$ and the acoustic resistance $r_T$ can be numerically specified as described below.

Specifically, when the maximum discharge frequency is set to 10 kHzM and the allowable overshoot value is set to 10 μm, largest optimum values of the higher limit value of the inertance $m_T$ and the acoustic resistance $r_T$ in the range to which the present invention applies (the maximum droplet diameter of an ink droplet $d_d$=38 to 43 μm, the nozzle opening diameter $d_3$=25 to 32 μm, and the surface tension of ink σ=25 to 35 mN/m) are obtained when the ink droplet diameter is $d_d$=38 μm, the nozzle opening diameter is $d_3$=25 μm, and the surface tension of ink is σ=35 mN/m. If the changing range of environmental temperature is about 10 to about 35° C., then the desirable upper limit value of the inertance $m_T$ will be about $1.9\times10^8$kg/m$^4$, and the allowable range of the acoustic resistance $r_T$ (20° C.) will be $9.0\times10^{12}<r_T<11.0\times10^{12}$[Ns/m]. Conversely, smallest optimum values of the upper limit value of the inertance $m_T$ and T of the acoustic resistance r are obtained when the ink droplet diameter is $d_d$=43 μm, the nozzle opening diameter is $d_3$=32 μm, and the surface tension of ink is σ=28 mN/m. At this time, the upper limit value of the inertance $m_T$ will be about $0.9\times10^8$kg/m$^4$, and the allowable range of the acoustic resistance $r_T$ (20° C.) will be $4.0\times10^{12}<r_T<5.0\times10^{12}$[Ns/m$^5$].

Accordingly, in the ink-jet recording head, which has been set to the range covered by the present invention (the maximum droplet diameter of an ink droplet is $d_d$=38 to 43 μm, the nozzle opening diameter is $d_3$=25 to 32 μm, and the surface tension of ink is σ=25 to 35 mN/m), in order to realize a maximum discharge frequency of 10 kHz or more and an allowable overshoot value of 10 μm over the entire environmental temperature range of about 10 to about 35° C., at least the conditions of expressions (13) and (14) must be satisfied:

$$0<m_T<1.9\times10^8[\text{kg/m}^4] \quad (13)$$

$$4.0\times10^{12}<r_T<11.0\times10^{12}[\text{Ns/m}^5] \quad (14)$$

The specific embodiments of the present invention will now be explained.

FIRST EMBODIMENT

Figure 2:
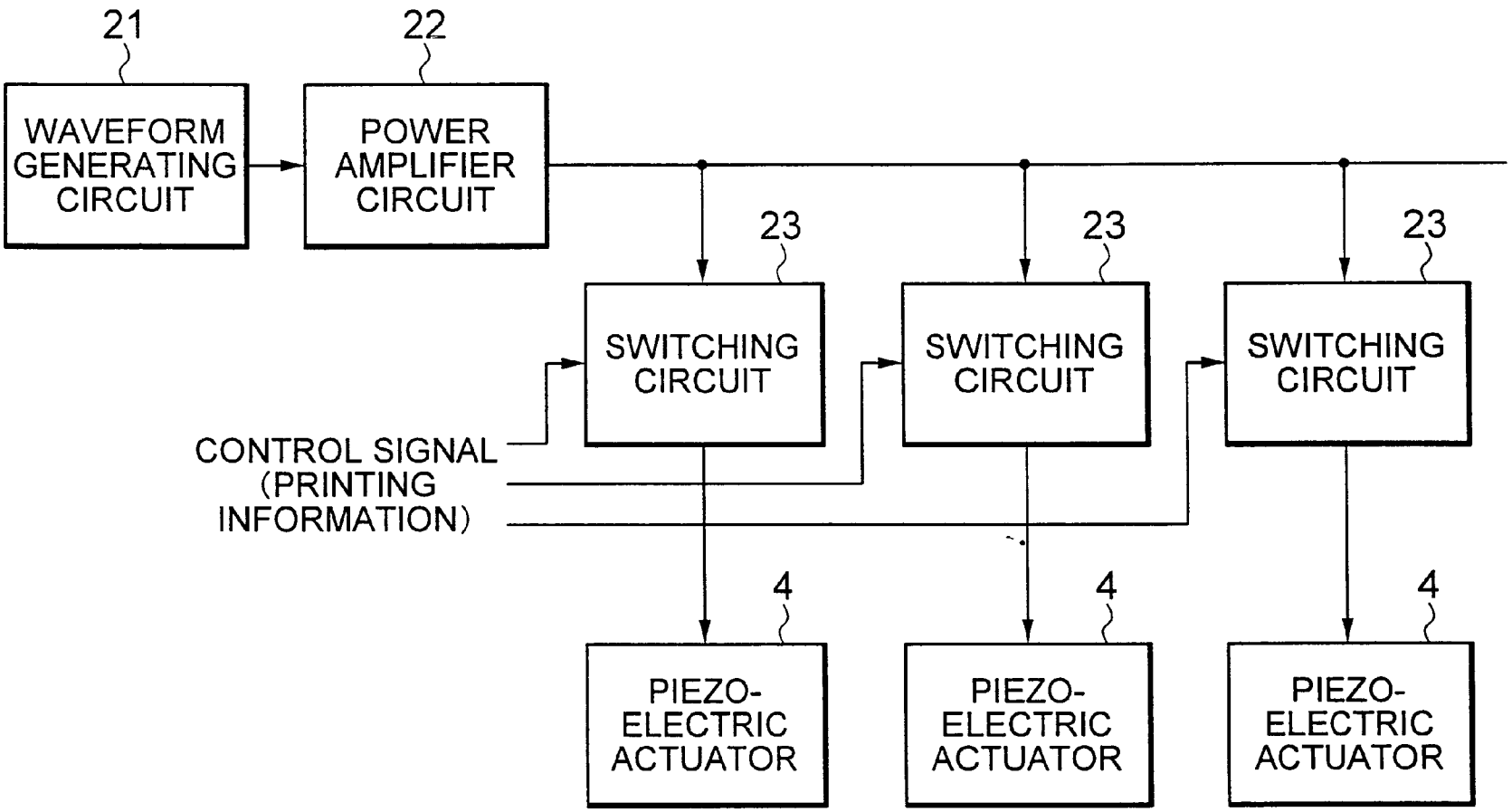
FIG. 2 is a block diagram showing an electrical configuration of a non-modulated droplet diameter type driving circuit that drives the ink-jet recording head in a binary mode.
Figure 3:
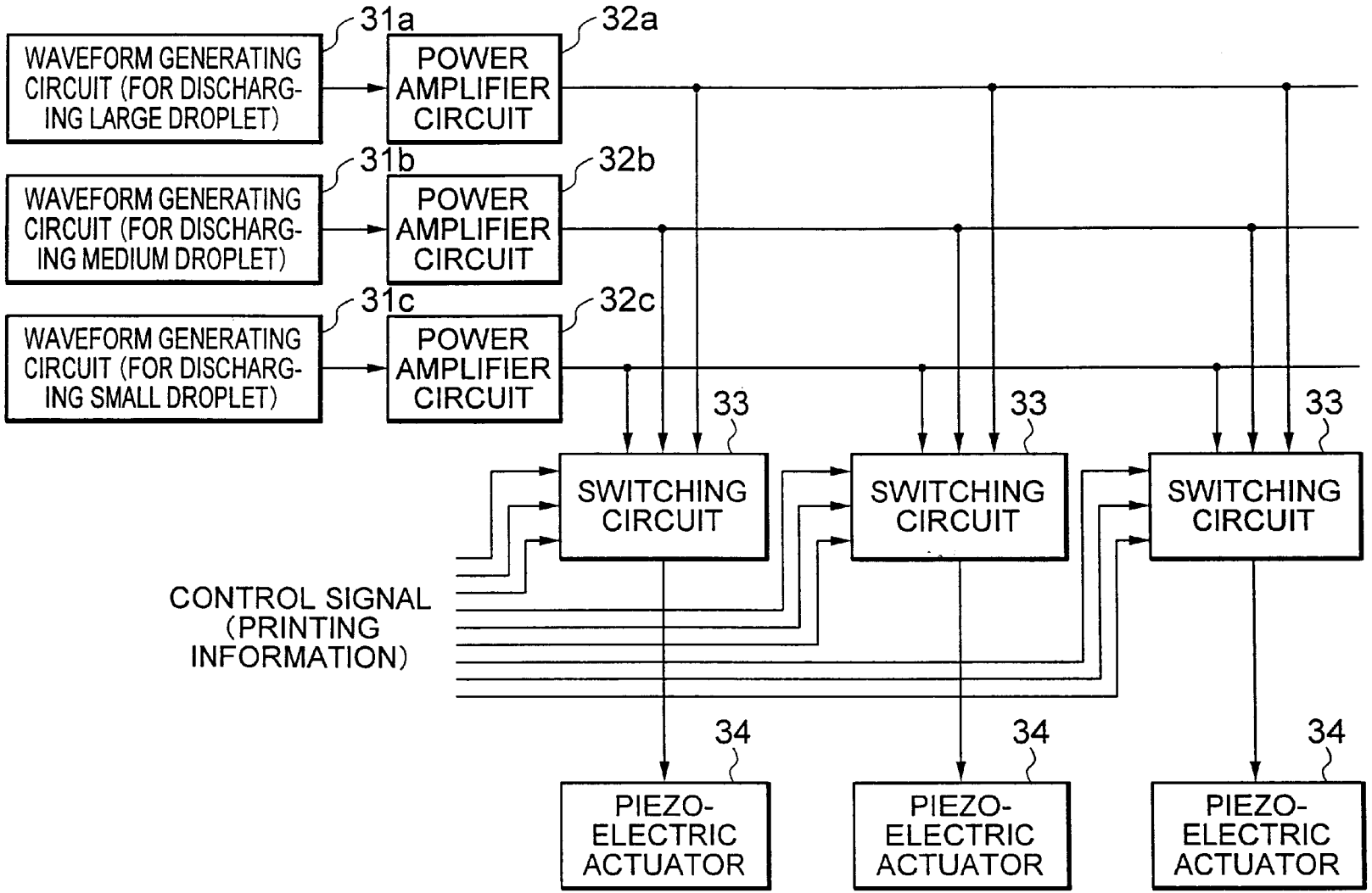
FIG. 3 is a block diagram showing an electrical configuration of a modulated droplet diameter type driving circuit that drives the ink-jet recording head in a multi-gray-scale mode.

FIG. 1(*a*) is a sectional view conceptually showing the construction of an ink-jet recording head mounted on an ink-Jet recording apparatus which is a first embodiment of the present invention, FIG. 1(*b*) is an exploded sectional view showing the ink-jet recording head in a disassembled state, FIG. 2 is a block diagram showing an electrical configuration of a non-modulated droplet diameter type driving circuit that drives the ink-jet recording head, and FIG. 3 is a block diagram showing an electrical configuration of a modulated droplet diameter type driving circuit that drives the ink-jet recording head.

The ink-jet recording head of this example is, as shown in FIG. 1(*a*), an on-demand Caesar type multi-nozzle recording head that discharges, as necessary, an ink droplet 1 to print a character or image on recording paper. As shown in FIG. 1(*a*), the recording head is primarily constituted by a plurality of pressure generating chambers 2 that are individually formed in long and slender cubic shapes and arranged vertically in the drawing, a diaphragm 3 making up the bottom surface of each of the pressure generating chambers 2 in the drawing, a plurality of piezoelectric actuators 4 that are provided side by side on the rear surfaces of the diaphragms 3 to match the pressure generating chambers 2 and are composed of laminated piezoelectric ceramics, a common ink chamber (ink pool) 5 coupled to an ink tank, which is not shown, to supply ink to the pressure generating chambers 2, a plurality of ink supply apertures (communication apertures) 6 for establishing one-to-one communication between the common ink chamber 5 and the pressure generating chambers 2, and a plurality of nozzles 7 that are provided to be keyed one-to-one to the pressure generating chambers 2, and discharge the ink droplet 1 from the distal ends projecting at the tops of the pressure generating chambers 2. The common ink chamber 5, the ink supply passages 6, the pressure generating chambers 2, and the nozzles 7 make up a passage system in which ink moves in this order. The piezoelectric actuators 4 and the diaphragms 3 make up a vibration system for applying a pressure wave to the ink in the pressure generating chambers 2. The contact points of the passage system and the vibration system provide the bottom surfaces of the pressure generating chambers 2 (i.e., the top surfaces of the diaphragms 3 in the drawing).

In the head manufacturing process of this embodiment, as shown in FIG. 1(*b*), a nozzle plate 7*a* in which the plurality of nozzles 7 are arranged and opened in columns or in a zigzag pattern, a pool plate 5*a* in which a space portion of the common ink chamber 5 is formed, a supply aperture plate 6*a* in which an ink supply aperture 6 is drilled, a pressure generating chamber plate 2*a* in which a plurality of space portions of the plurality of pressure generating chambers 2 are formed, and vibrating plates 3*a* constituting the plurality of diaphragms 3 are prepared in advance. Thereafter, these plates 2*a*, 3*a*, and 5*a* through 7*a* are adhesively bonded using an epoxy-based adhesive agent layer having a thickness of approximately 20 $\mu$m, not shown, to make a laminated plate. Then, the prepared laminated plate and the piezoelectric actuator 4 are bonded using an epoxy-based adhesive agent layer thereby to fabricate the ink-jet recording head having the aforesaid construction. In this example, a nickel plate that is produced by electrocasting (electroforming) and has a thickness of 50 to 75 $\mu$m is used for the vibrating plate 3*a*, while a stainless plate having a thickness of 50 to 75 $\mu$m is used for the other plates 2*a* and 5*a* through 7*a*.

Referring now to FIG. 2 and FIG. 3, the descriptions will be given of the electrical configuration of a driving circuit that constitutes the ink-jet recording apparatus of this example, and drives the ink-jet recording head having the aforesaid construction.

The ink-jet recording apparatus of this example has a CPU (central processing unit) and memories, such as a ROM and RAM, which are not shown. The CPU controls the components of the apparatus by executing a program stored in the ROM and employing diverse registers and flags secured in the RAM to print characters or images on recording paper on the basis of printing information supplied from a host apparatus, such as a personal computer, through an interface.

First, the driving circuit shown in FIG. 2 produces and power-amplifies a predetermined driving waveform signal, then supplies the signal to predetermined piezoelectric actuators 4, 4, . . . associated with the printing information to drive the actuators so as to discharge the ink droplet 1, which always has substantially the same droplet diameter, to print a character or an image on the recording paper. The driving circuit is constituted primarily by a waveform generating circuit 21, a power amplifier circuit 22, and a plurality of switching circuits 23, 23, . . . connected to the piezoelectric actuators 4, 4, . . . in a one-to-one fashion.

The waveform generating circuit 21 is formed by a digital-to-analog converting circuit and an integrating circuit, and converts the driving waveform data read from a predetermined storage area of the ROM by the CPU into analog data, then performs integration on the analog data to generate a driving waveform signal. The power amplifier circuit 22 power-amplifies the driving waveform signal supplied from the waveform generating circuit 21, and outputs the amplified driving waveform signal as a voltage waveform signal. The switching circuit 23 has its input end connected to an output end of the power amplifier circuit 22, and its output end connected to one end of the associated piezoelectric actuator 4. Application of a control signal associated with printing information output from the driving control circuit, not shown, to its control end causes the switching circuit 23 to be turned ON so as to apply a voltage waveform signal output from the associated power amplifier circuit 22 to the piezoelectric actuator 4. At this time, the piezoelectric actuator 4 causes the diaphragm 3 to be displaced on the basis of the applied voltage waveform signal. The displacement of the diaphragm 3 causes a change in the volume of the pressure generating chamber 2 so as to generate a predetermined pressure wave in the pressure generating chamber 2 filled with ink, and the ink droplet 1 of a predetermined droplet diameter is discharged from the nozzle 7 by the pressure wave. The discharged ink droplet impacts onto a recording medium, such as recording paper, to form a recording dot. Such a recording dot is repeatedly formed on the basis of the printing information thereby to form a character or an image on the recording paper in the binary mode.

The driving circuit shown in FIG. 3 is a droplet-diameter-modulating type driving circuit adapted to change the diameter of the ink droplet discharge from the nozzle in multiple steps (in three steps, namely, a large droplet having a droplet diameter of about 40 $\mu$m, a medium droplet of about 30 $\mu$m, and a small droplet of about 20 $\mu$m in this example) to print characters or images on recording paper in multiple gray scales. The driving circuit is formed primarily by three types of waveform generating circuits 31*a*, 31*b*, and 31*c* for different droplet diameters, power amplifier circuits 32*a*, 32*b*, and 32*c* connected to these waveform generating circuits 31*a*, 31*b*, and 31*c*, respectively, in the one-to-one fashion, and a plurality of switching circuits 33, 33, . . . connected to the piezoelectric actuators 4, 4, . . . in the one-to-one fashion.

Each of the waveform generating circuits 31*a* through 31*c* is composed of a digital-to-analog converting circuit and an integrating circuit. Of the waveform generating circuits 31*a* through 31*c*, the waveform generating circuit 31*a* converts the driving waveform data for discharging large droplets read from a predetermined storage area of the ROM by the CPU into analog data, and carries out integration on the data to produce the driving waveform signal for discharging large droplets. The waveform generating circuit 31*b* converts the driving waveform data for discharging medium droplets read from a predetermined storage area of the ROM by the CPU into analog data, and carries out integration on the data to produce the driving waveform signal for discharging medium droplets. The waveform generating circuit 31*c* converts the driving waveform data for discharging small droplets read from a predetermined storage area of the ROM by the CPU into analog data, and carries out integration on the data to produce the driving waveform signal for discharging small droplets. The power amplifying circuit 32*a* power-amplifies the driving waveform signal for discharging large droplets supplied from the waveform generating circuit 31*a*, and outputs the amplified signal as a voltage waveform signal for discharging large droplets. The power amplifying circuit 32*b* power-amplifies the driving waveform signal for discharging medium droplets supplied from the waveform generating circuit 31*b*, and outputs the amplified signal as a voltage waveform signal for discharging medium droplets. The power amplifying circuit 32*c* power-amplifies the driving waveform signal for discharging small droplets supplied from the waveform generating circuit 31*c*, and outputs the amplified signal as a voltage waveform signal for discharging small droplets, The switching circuit 33 is composed of first, second, and third transfer gates, not shown. An input end of the first transfer gate is connected to an output end of the power amplifier circuit 32*a*, an input end of the second transfer gate is connected to an output end of the power amplifier circuit 32*b*, and an input end of the third transfer gate is connected to an output end of the power amplifier circuit 32*c*. Output ends of the first, second, and third transfer gates are connected to one end of a corresponding common piezoelectric actuator 4. When a gray scale control signal based on the printing information output from a driving control circuit, not shown, is input to a control end of the first transfer gate, the first transfer gate is turned ON to apply the voltage waveform signal for discharging a large droplet, which is output from the power amplifier circuit 32*a*, to the piezoelectric actuator 4. At this time, the piezoelectric actuator 4 supplies a displacement based on the applied voltage waveform signal to the diaphragm 3 so as to cause a sudden change (increase or decrease) in the volume of the pressure generating chamber 2 by the displacement of the diaphragm 3. This causes a predetermined pressure wave to be produced in the pressure generating chamber 2 filled with ink thereby to discharge the ink droplet 1 of a large size from the nozzle 7 by the pressure wave. When a gray scale control signal based on the printing information output from a driving control circuit is input to a control end of the second transfer gate, the second transfer gate is turned ON to apply the voltage waveform signal for discharging a medium droplet, which is output from the power amplifier circuit 32*b*, to the piezoelectric actuator 4. At this time, the piezoelectric actuator 4 supplies a displacement based on the applied voltage waveform signal to the diaphragm 3 so as to change the volume of the pressure generating chamber 2 by the displacement of the diaphragm 3. This causes a predetermined pressure wave to be produced in the pressure generating chamber 2 filled with ink thereby to discharge the ink droplet 1 of a medium size from the nozzle 7 by the pressure wave. When a gray scale control signal based on the printing information output from a driving control circuit is input to a control end of the third transfer gate, the third transfer gate is turned ON to apply the voltage waveform signal for discharging a small droplet, which is output from the power amplifier circuit 32*c*, to the piezoelectric actuator 4. At this time, the piezoelectric actuator 4 supplies a displacement based on the applied voltage waveform signal to the diaphragm 3 so as to change the volume of the pressure generating chamber 2 by the displacement of the diaphragm 3. This causes a predetermined pressure wave to be produced in the pressure generating chamber 2 filled with ink thereby to discharge the ink droplet 1 of a small size from the nozzle 7 by the pressure wave. The discharged ink droplet impacts onto a recording medium, such as recording paper, to form a recording dot. Such recording dots are repeatedly formed on the basis of printing information so as to record characters or images in multiple gray scales on recording paper.

In this embodiment, the ink-jet recording apparatus exclusively used for binary recording incorporates the driving circuit shown in FIG. 2, while the ink-jet recording apparatus that also performs gray-scale recording incorporates the driving circuit shown in FIG. 3.

Figure 4:
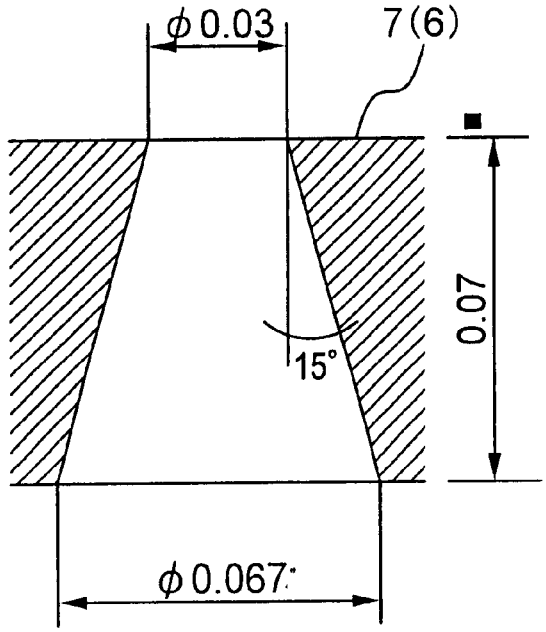
FIG. 4 is a sectional view showing the shape of a nozzle constituting the ink-jet recording head (an ink supply aperture has the same shape)
Figure 5:
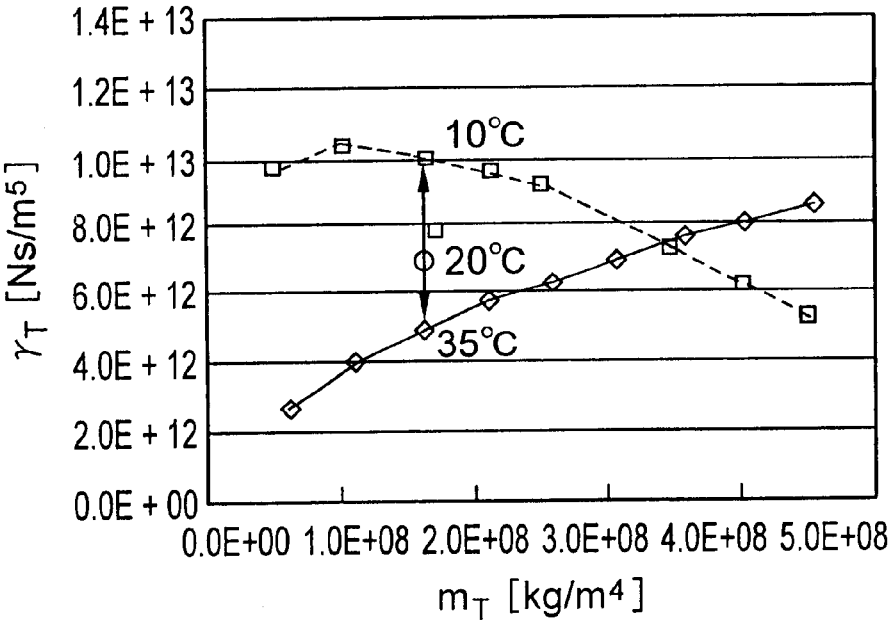
FIG. 5 is a graph showing the relationship between an inertance $m_T$ and an acoustic resistance $r_T$ of an entire passage diameter in the embodiment.
Figure 6:
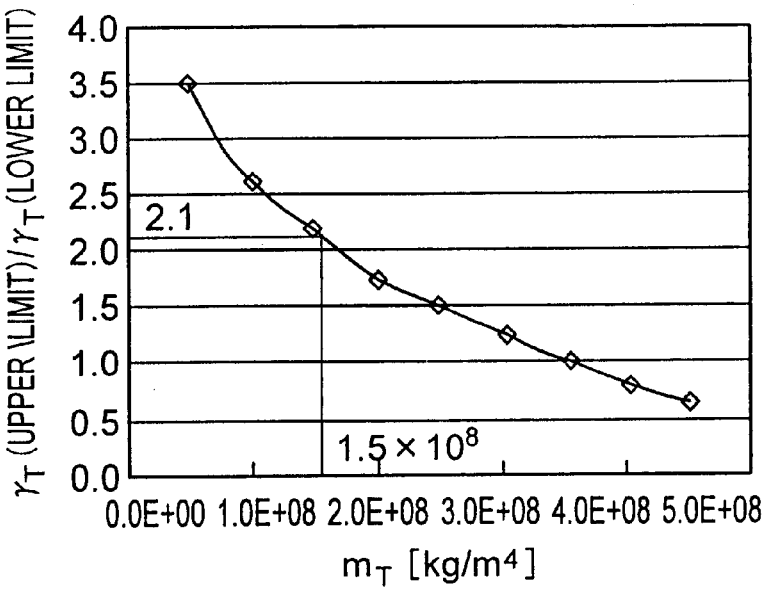
FIG. 6 is a graph showing the relationship between an inertance $m_T$ and an acoustic resistance $r_T$ of an entire passage diameter in the embodiment.

FIG. 4 is a sectional view showing the shape of the nozzle 7 in this embodiment (the ink supply aperture 6 shares the same shape). FIG. 5 and FIG. 6 show the graphs illustrating the relationship between the inertance $m_T$ and the acoustic resistance $r_T$ of the entire passage diameter in the embodiment. FIG. 6 shows a graph based on the one shown in FIG. 5, wherein the axis of ordinates indicates the ratio of the upper limit and the lower limit of the acoustic resistance $r_T$ of the entire passage diameter.

In this case, the inertance $m_T$ of the entire passage system means the total sum of the inertances of the nozzle 7, the ink supply passage 6, and the pressure generating chamber 2 in the ink-filled state. Similarly, the acoustic resistance of the entire passage diameter means the total sum of the acoustic resistances of the nozzle 7, the ink supply passage 6, and the pressure generating chamber 2 in the ink-filled state.

The nozzle 7 in this example is formed by punching an aperture by precision pressing in a stainless plate having a thickness of about 70 $\mu$m, and formed into a round aperture having an opening diameter of about 30 $\mu$m. Furthermore, the inner part of the nozzle 7 is tapered to have a tapering angle of about 15 degrees, a skirt diameter of about 67 $\mu$m, and a length of about 70 $\mu$m, as shown in FIG. 4. The ink supply aperture 6 shares the same shape with the nozzle 7. In this embodiment, ink is employed that has been adjusted to have a surface tension of 33 mN/m and a viscosity of 4.5 mPa·s at 20° C. The ink develops about a 2.1-fold change in the viscosity due to a change in environmental temperature of 10 to 35° C.

In the ink-jet recording head in this example, when the environmental temperature is the room temperature (20° C.), the combination of the inertance $m_T$ and the acoustic resistance $r_T$ of the entire head passage diameter is set such that it lies at the position indicated by plotting O and the total sum $r_T$ of the acoustic resistance always stays between the upper limit value and the lower limit value even when the environmental temperature changes in the range of 10 to 35° C., as shown in FIG. 5. Hence, as can be understood from FIG. 5, the target refilling time (100 $\mu$s or less) can be secured, and the overshoot can be suppressed (10 $\mu$m or less) at the same time over the entire temperature range of 10 to 35° C.

The descriptions will now be given of a specific procedure according to which the shapes of the nozzle 7 and the ink supply aperture 6, and the viscosity of the ink have been decided as mentioned above.

FIG. 5 shows the results of the determination of the allowable range of the acoustic resistance and the inertance $m_T$ of the entire passage diameter performed under a condition of a droplet diameter of 40 μm, a discharge frequency of 10 kHz, an allowable overshoot amount of 10 μm, an ink surface tension of 33 mN/m, and a nozzle opening diameter of 30 μm. As mentioned above, the ink develops about 2.1-fold viscosity change in response to changes in environmental temperature of 10 to 35° C. Accordingly, the acoustic resistance $r_T$ of the entire passage diameter changes 2.1 times due to the changes in the environmental temperature of 10 to 35° C. It means, therefore, it the allowable range (the ratio of the upper limit to the lower limit) of the acoustic resistance $r_T$ of the entire passage diameter cannot accommodate the 2.1-fold change, then the apparatus cannot successfully cope with changes in the environmental temperature. As is obvious from FIG. 6, as the inertance $m_T$ of the entire passage diameter reduces, the ratio of the upper limit to the lower limit tends to increase. When the inertance of the entire passage diameter is $m_T<1.5\times10^8$ kg/m$^4$, then the ratio of the upper limit to the lower limit is 2.1 or more. Thus, It can be understood that the inertance $m_T$ of the entire passage diameter should be set to $1.5\times10^8$ kg/m$^4$ or less to accommodate a 2.1-fold change in the acoustic resistance $r_T$ of the entire passage diameter.

Subsequently, the inertance $m_T$ of the entire passage diameter determined as mentioned above is distributed to the three components, namely, the nozzle 7, the ink supply aperture 6, and the pressure generating chamber 2. First, the inertance of the pressure generating 4 chamber 2 changes according to the shape of the pressure generating chamber 2. If an attempt is made to set the maximum ink droplet diameter to 38 to 43 μm and the proper period of a pressure wave to about 10 to about 20 μs, then the inertance of the pressure generating chamber 2 will normally be about 0.4 to about $0.6\times10^8$ kg/m$^4$. In the case of this embodiment, the pressure generating chamber 2 is shaped to have a width of 320 μm, a height of 140 μm, and a length of 2.5 mm. Hence, the inertance of the pressure generating chamber 2 will be $0.56\times10^8$ kg/m$^4$. Thus, in order to set the inertance $m_T$ of the entire passage diameter to $1.5\times10^8$ kg/m$^4$, it is necessary to set the sum of the inertance of the nozzle 7 and the inertance of the ink supply aperture 6 to $0.94\times10^8$ kg/m$^4$. Since the nozzle 7 and the ink supply aperture 6 substantially share the same shape, the inertance of these two components should be substantially set to be equal. Therefore, the upper limit value of the inertances of these two components is determined to be $0.47\times10^8$ kg/m$^4$.

To reduce the inertances of the nozzle 7 and the ink supply aperture 6, it is effective to increase the passage diameter (the passage sectional area) and reduce the passage length. However, if the opening diameter of the nozzle 7 increases, then adverse influences, such as a drop in droplet speed or deteriorated stability in the discharge of minute droplets, are likely to take place. For this reason, it is not desirable to considerably increase the opening diameter of the nozzle. Furthermore, if the nozzle length is small, then more air bubbles are likely to be introduced into the head immediately after discharging. Therefore, it is not desirable to considerably reduce the nozzle length. On the other hand, it has been found that, in order to ensure stable discharge of ink droplets having a droplet diameter of about 38 to about 43 μm at a droplet speed of about 6 to about 10 m/s, the optimum nozzle opening diameter ranges from about 25 to 32 μm and the optimum nozzle length ranges from about 70 to about 100 μm. To reduce the inertance of the nozzle 7 under such a condition, increasing the tapering angle will be the most effective means. Therefore, in this embodiment, the inertance of the nozzle 7 was brought to a target value, $0.44\times10^8$ kg/m$^4$, by setting the nozzle diameter to 30 μm, the nozzle length to 70 μm, and the tapering angle to 15 degrees.

The optimum value of the tapering angle changes according to the nozzle diameter, the nozzle length, the inertance of the pressure generating chamber, etc. As mentioned above, however, an optimum tapering angle is 10 degrees or more, considering that the optimum nozzle opening diameter ranges from about 25 to 32 μm, and the optimum nozzle length ranges from about 70 to about 100 μm, and it is difficult to significantly increase or decrease the inertance of the pressure generating chamber 2. However, a tapering angle exceeding 45 degrees is not preferable from the viewpoint of involvement of air bubbles and the strength of nozzle.

In this embodiment, as previously mentioned, the ink supply aperture 6 is formed to have the same shape as that of the nozzle 7 so as to provide the same inertance as that of the nozzle 7.

After completion of setting of the inertance $m_T$ of the entire passage diameter, the ink viscosity is set. To be more specific, calculation is performed to obtain the ink viscosity at the environmental temperature of 35° C. so that the acoustic resistance $r_T$ is set to the lower limit value ($4.9\times10^{12}$ Ns/m$^5$) of the acoustic resistance $r_T$ at the inertance $m_T=1.5\times10^8$ kg/m$^4$. In this embodiment, setting the ink viscosity to 3.0 mPa·s causes the acoustic resistance $r_T$ to substantially coincide with the lower limit value ($4.9\times10^{12}$ Ns/m$^5$), showing that the viscosity is the optimum ink viscosity at the highest temperature (35° C.). Thus, the ink viscosity at the lowest temperature (10° C.) will be 2.1 times the viscosity at the highest temperature, that is, 6.3 mPa·s, and the acoustic resistance $r_T$ at that time will be $10.1\times10^{12}$ Ns/m$^5$. This is the upper limit value or less of the acoustic resistance $r_T$, and it is possible to secure the target refilling time even at the lowest temperature. In this case, the ink viscosity at the room temperature (20° C.) will be substantially 4.5 mPa·s (the viscosity at 20° C. is about 1.5 times the viscosity at 10° C.), and the acoustic resistance $r_T$ will be $7.2\times10^{12}$ Ns/m$^5$.

Thus, by forming the nozzle 7 and the ink supply aperture 6 into a taper shape having a tapering angle of 15 degrees, and setting the ink viscosity substantially to 4.5 mPa·s (20° C.), it is possible to secure the refilling time and also to restrain the overshoot at the same time over the entire apparatus operating temperature range. The actually implemented evaluation of the refilling characteristics of the ink-jet recording head according to this embodiment has proven that the refilling time was 98 μs and the overshoot amount was 2.1 μm at the lowest temperature (10° C.), while the refilling time was 64 μs and the overshoot amount was 9.7 μm at the highest temperature (35° C.). In other words, it has been possible to confirm that the overshoot can be controlled (10 μm or less) and also to achieve a target driving frequency (10 kHz) at the same time over the entire apparatus operating temperature range.

SECOND EMBODIMENT

Figure 7:
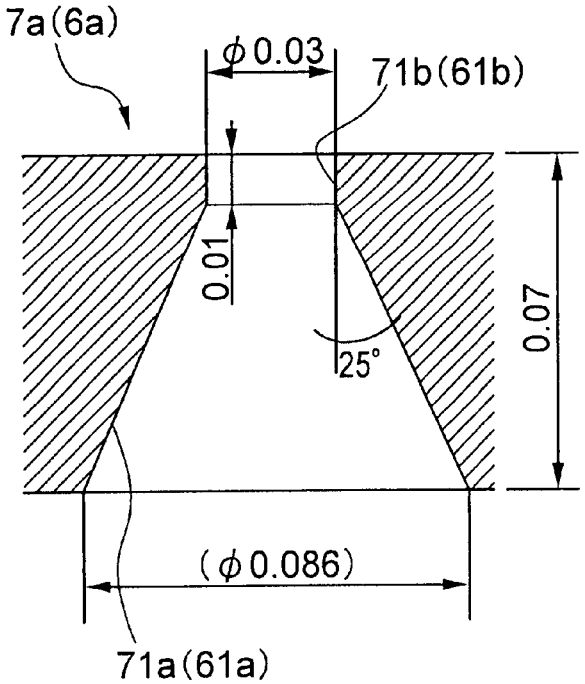
FIG. 7 is a sectional view showing the shape of a nozzle (an ink supply aperture has the same shape) that is a second embodiment of the present invention.

FIG. 7 is a sectional view showing the shape of a nozzle (an ink supply aperture has the same shape) that is a second embodiment of the present invention.

The construction of the second embodiment is significantly different from that of the foregoing first embodiment in that a nozzle 7*a* and an ink supply aperture 6*a* of the second embodiment are provided with straight portions 71*b* and 61*b* in the vicinity of their apertures in addition to tapered portions 71*a* and 61*a* that gradually increase toward a pressure generating chamber 2, as shown in FIG. 7, whereas the entire inner portions of the nozzle 7 and the ink supply aperture 6 (FIG. 4) of the first embodiment are tapered, and also in that the tapering angle is set to 15 to 45 degrees in place of 10 degrees or more.

In the nozzle 7*a* and the ink supply aperture 6*a* of the second embodiment, the opening diameter is set to 30 $\mu$m, the length of the straight portions 71*b* and 61*b* is set to 10 $\mu$m, the total length is set to 70 $\mu$m, and the tapering angle is set to 25 degrees so as to adjust the inertance of each component to $0.44\times10^8$ kg/m$^4$. Hence, if the inertance ($0.56\times10^8$ kg/m$^4$) of the pressure generating chamber 2 is added, then the inertance $m_T$ of the entire passage diameter will be $1.43\times10^8$ kg/m$^4$, which is a value of the upper limit value ($1.5\times10^8$ kg/m$^4$) or less of the inertance $m_T$ of the entire passage diameter obtained from FIG. 6. The optimum value of the tapering angle depends on the length of the straight portions, the nozzle diameter, the nozzle length, etc. as mentioned above. However, considering an optimum nozzle opening diameter, the strength of a nozzle, the prevention of involving air bubbles, etc., the optimum tapering angle will be 15 degrees or more and 45 degrees or less for a practical shape (the length of the straight portions is about 10 to about 20 $\mu$m).

Next, adjusting the ink viscosity at an environmental temperature of 35° C. to 2.3 mPa·s makes it possible to meet the lower limit value ($4.9\times10^{12}$ Ns/m$^5$) of the acoustic resistance $r_T$ at the inertance $m_T=1.5\times10^8$ kg/m$^4$ of the entire passage diameter, and this will be the optimum ink viscosity at a highest temperature (35° C.). Hence, the ink viscosity at a lowest temperature (10° C.) will be 4.8 mPa·s. Furthermore, the ink viscosity at room temperature (20° C.) will be about 3.5 mPa·s, and the acoustic resistance $r_T$ will be $7.3\times10^{12}$ Ns/m$^5$.

Thus, the target refilling time (100 $\mu$s) can be secured and the overshoot can be restrained (10 $\mu$m or less) at the same time over the entire apparatus operating temperature range by setting the opening diameters of the nozzle 7*a* and the ink supply aperture 6*a* to 30 $\mu$m, the length of the straight portions 71*b* and 61*b* thereof to 10 $\mu$m, the tapering angles thereof to 25 degrees, and the ink viscosity to substantially 3.5 mPa·s (20° C.).

Since the nozzle 7*a* and the ink supply aperture 6*a* are provided with the straight portions 7*b* and 61*b*, the variations in the opening diameter in the manufacture can be reduced, thus permitting the variations in the characteristics of nozzles or heads to be restrained.

The actually implemented evaluation of the refilling characteristics of the ink-jet recording head according to the second embodiment has proven that the refilling time was 96 $\mu$s and the overshoot amount was 2.5 $\mu$m at the lowest temperature (10° C.), while the refilling time was 62 $\mu$s and the overshoot amount was 9.8 $\mu$m at the highest temperature (35° C.). In other words, it has been possible to confirm that stable operation can be performed at the target drive frequency (10 kHz) without causing excessive overshoot over the entire apparatus operating temperature range.

THIRD EMBODIMENT

Figure 8:
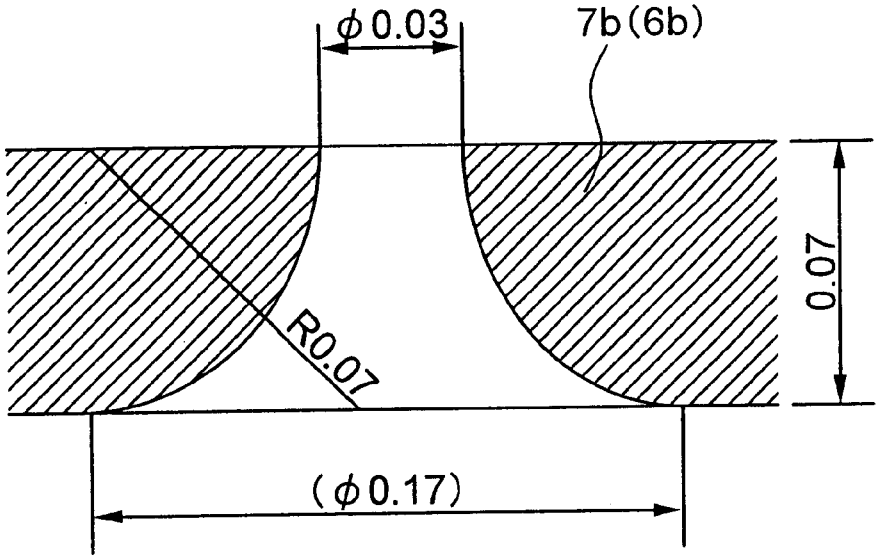
FIG. 8 is a sectional view showing the shape of a nozzle (an ink supply aperture has the same shape) that is a third embodiment of the present invention.

FIG. 8 is a sectional view showing the shape of a nozzle (an ink supply aperture has the same shape) that is a third embodiment of the present invention.

The third embodiment is characterized in that the diameters of the nozzle 7*b* and the ink supply aperture 6*b* gradually increase toward the pressure generating chamber 2, the longitudinal sections of the nozzle 7*b* and the ink supply aperture 6*b* have a round shape having substantially equal radius to the length of the nozzle 7*b* and the ink supply aperture 6*b*, and the length of the nozzle 7*b* and the ink supply aperture 6*b* is set to 50 to 100 $\mu$m (preferably 70 to 100 $\mu$m).

The nozzle 7*b* and the ink supply aperture 6*b* in this example are prepared by electrocasting (electroforming).

In the nozzle 7*b* and the ink supply aperture 6*b* of this example, the opening diameter is set to 30 $\mu$m and the length is set to 70 $\mu$m, and the inertances thereof are both $0.44\times10^8$ kg/m$^4$. Hence, if the inertance ($0.56\times10^8$ kg/m$^4$) of the pressure generating chamber 2 is added, then the inertance $m_T$ of the entire passage system will be $1.43\times10^8$ kg/m$^4$, which is a value of the upper limit value or less of the inertance $m_T$ of the entire passage system, as is obvious from FIG. 6. When the opening diameter of the nozzle is set to 25 to 32 $\mu$m, the nozzle length must be set to 100 $\mu$m or less in order to obtain a required inertance.

Next, adjusting the ink viscosity at an environmental temperature of 35° C. to 2.2 mPa·s makes it possible to meet the lower limit value ($4.9\times10^{12}$ Ns/m$^5$) of the acoustic resistance $r_T$ at the inertance $m_T=1.5\times10^8$ kg/m$^4$ of the entire passage diameter, and this will be the optimum ink viscosity at a highest temperature (35° C.). Hence, the ink viscosity at a lowest temperature (10° C.) will be 2.1 times the viscosity at the highest temperature, i.e., 4.6 mPa·s. The acoustic resistance $r_T$ at that time will be $10.0\times10^{12}$ Ns/m$^5$. This is the upper limit value or less of the acoustic resistance $r_T$, and the target refilling time can be secured even at the lowest temperature. In this case, the ink viscosity at room temperature (20° C.) will be about 3.3 mPa·s, and the acoustic resistance $r_T$ at that time will be $7.2\times10^{12}$ Ns/m$^5$.

Thus, the target refilling time (100 $\mu$s) can be secured and the overshoot can be restrained (10 $\mu$m or less) at the same time over the entire apparatus operating temperature range by forming the nozzle 7*b* and the ink supply aperture 6*b* such that their opening diameter is 30 $\mu$m, and they are shaped to have radii and a length of 70 $\mu$m, and by setting the ink viscosity to approximately 3.3 mPa·s (20° C.).

The actually implemented evaluation of the refilling characteristics of the ink-jet recording head according to the third embodiment has proven that the refilling time was 98 $\mu$s and the overshoot amount was 2.0 $\mu$m at the lowest temperature (10° C.), while the refilling time was 65 $\mu$s and the overshoot amount was 9.6 $\mu$m at the highest temperature (35° C.). In other words, it has been possible to confirm that stable operation can be performed at a target drive frequency (10 kHz) without causing excessive overshoot over the entire apparatus operating temperature range.

Thus, the embodiments in accordance with the present invention have been described in detail in conjunction with the drawings. Specific constructions, however, are not limited to the embodiments, and modifications or the like in design within a scope of the spirit of the present invention will be included in the present invention. For example, the shapes of the nozzle and the ink supply aperture are not limited to the taper shape or the radius shape. Similarly, the shape of the opening is not limited to the round shape, and it may alternatively be a rectangular, triangular, or other shape. The ink supply passage for moving the ink pooled in a common ink supply chamber to a pressure generating chamber is not limited to the ink supply aperture drilled in the plate, and it may alternatively be a cylindrical or tubular ink supply passage. Furthermore, the positional relationship among the nozzle, the pressure generating chamber, and the ink supply aperture is not limited to the structure shown in this embodiment. For example, it is of course possible to dispose the nozzle at the central part or the like of the pressure generating chamber.

In the embodiments described above, the nozzle 7 and the ink supply aperture 6 sharing the same shape have been used, but they do not have to share the same shape, and the ink supply aperture may have any shape. The ink supply aperture does not have much limitation in its diameter or length, so that it has a higher degree of freedom in its shape as compared with the nozzle. For instance, if the ink supply aperture has a straight shape (zero-degree tapering angle) with a diameter of 45 $\mu$m and has a length of 70 $\mu$m, it is still possible to obtain the inertance of $0.44\times10^8$ kg/m$^4$, which is the target in the first embodiment described above.

In the foregoing embodiments, although the inertance of the ink supply aperture has been set to the same value as that of the nozzle, the present invention is not limited thereto. From the viewpoint of discharging efficiency, the inertance of the nozzle 7 is preferably set to be smaller than the inertance of the ink supply aperture 6 as long as the target inertance is obtained in the entire passage diameter. This is because, if the inertance of the nozzle 7 is larger than that of the ink supply aperture 6, then the amount of the energy of the pressure wave that escapes to the ink supply aperture 6 increases, resulting in lower discharging efficiency. However, for the convenience of manufacture, the inertances of both may be set to substantially equal values, as described in the foregoing embodiments.

In the foregoing embodiments, the cases have been described where the present invention has been applied to the Caesar-type ink-jet recording head, The application of the present invention, however, is not limited to the Caesar-type ink-jet recording head as long as it is an ink-jet recording head adapted to discharge ink droplets from a nozzle by causing a change in pressure in a pressure generating chamber by a pressure generating means.

Similarly, in addition to a piezoelectric actuator, another type of electromechanical transducing element, a magnetostrictive element, or an electro-thermal converting element may be used as a pressure generating means.

INDUSTRIAL APPLICABILITY

As explained above, the construction in accordance with the present invention makes it possible to always secure a target refilling time (approximately 100 $\mu$s) and control overshoot to approximately 10 $\mu$m or less even if the environmental temperature changes in a range of about 10 to about 35° C. when an apparatus is in operation. Therefore, high accuracy and stability can be secured for ink droplet diameters even when the apparatus is operated at high speed. This enables ink-jet gray-scale recording at high speed with high image quality (by droplet diameter modulation) to be achieved.

What is claimed is:

1. An ink-jet recording head comprising a pressure generating chamber to be filled with ink, pressure generating means for generating a pressure in said pressure generating chamber, an ink supply chamber for supplying the ink to said pressure generating chamber, an ink supply passage for establishing communication between said ink supply chamber and said pressure generating chamber, and a nozzle in communication with said pressure generating chamber, said pressure generating means causing a pressure change to take place in said air pressure generating chamber so as to discharge an ink droplet from said nozzle;

wherein the configurations of said nozzle, said ink supply passage, and said pressure generating chamber are set so that a total sum $m_T$ of inertance and a total sum $r_T$ of acoustic resistance (the values at a temperature of general 20° C.) of said nozzle, said ink supply passage, and said pressure generating chamber in an ink-filled state satisfy expressions (1) and (2), respectively:

$$0<m_T<1.9\times10^8[\mathrm{kg/m^4}] \quad (1)$$

$$4.0\times10^{12}<r_T<11.0\times10^{12}[\mathrm{Ns/m^5}] \quad (2)$$

2. An ink-jet recording head according to claim 1, wherein said nozzle has a tapered portion whose diameter gradually increases toward said pressure generating chamber, and the tapering angle of said tapered portion is 10 to 45 degrees.

3. An ink-jet recording head according to claim 2, wherein the opening diameter of said nozzle is 25 to 32 $\mu$m.

4. An ink-jet recording apparatus comprising said ink-jet recording head according to claim 2.

5. An ink-jet recording head according to claim 1, wherein said nozzle is composed of a straight portion provided in the vicinity of an opening and a tapered portion that gradually increases toward said pressure generating chamber, and the tapering angle of said tapered portion is 15 to 45 degrees.

6. An ink-jet recording head according to claim 5, wherein the opening diameter of said nozzle is 25 to 32 $\mu$m.

7. An ink-jet recording apparatus comprising said ink-jet recording head according to claim 5.

8. An ink-jet recording head according to claim 1, wherein the diameter of said nozzle gradually increases toward said pressure generating chamber, the longitudinal section of said nozzle is shaped into a curve that has a radius substantially equal to the length of said nozzle, and the length of said nozzle is 50 to 100 $\mu$m.

9. An ink-jet recording head according to claim 8, wherein the opening diameter of said nozzle is 25 to 32 $\mu$m.

10. An ink-jet recording apparatus comprising said ink-jet recording head according to claim 8.

11. An ink-jet recording head according to claim 1, wherein the opening diameter of said nozzle is 25 to 32 $\mu$m.

12. An ink-jet recording apparatus comprising said ink-jet recording head according to claim 11.

13. An ink-jet recording head according to claim 1, wherein said ink supply passage is an ink supply aperture for establishing communication between said ink supply chamber and said pressure generating chamber.

14. An ink-jet recording apparatus comprising said ink-jet recording head according to claim 6.

15. An ink-jet recording head according to claim 1, wherein a maximum droplet diameter of the ink droplet is set to 38 to 43 $\mu$m.

16. An ink-jet recording apparatus comprising said ink-jet recording head according to claim 15.

17. An ink-jet recording head according to claim 1, wherein said ink-jet recording head employs an ink with its surface tension set to 25 to 35 mN/m.

18. An ink-jet recording head described in claim 1, wherein said ink-jet recording head employs an ink having its viscosity set such that the total sum $r_T$ of the acoustic resistance (the value at a temperature of substantially 20° C.) of said nozzle, said ink supply passage, and said pressure generating chamber in an ink-filled state satisfies expression (3):

$$4.0\times10^{12}<r_T<11.0\times10^{12}[\mathrm{Ns/m^5}] \quad (3)$$

19. An ink-jet recording head according to claim 1, comprising a laminated plate constructed by bonding a nozzle plate wherein said nozzle has been drilled, a pool plate wherein a space portion of said ink supply chamber is formed, a supply aperture plate wherein said ink supply passage has been drilled, a pressure generating chamber plate wherein a space portion of said pressure generating chamber has been formed, and a vibrating plate constituting a part of said pressure generating means, and a piezoelectric actuator acting other part of said pressure generating means bonded to said laminated plate.

20. An ink-jet recording apparatus comprising said ink-jet recording head according to claim 1.

* * * * *